United States Patent [19]

Moisan

[11] Patent Number: 4,906,898

[45] Date of Patent: Mar. 6, 1990

[54] SURFACE WAVE LAUNCHERS TO PRODUCE PLASMA COLUMNS AND MEANS FOR PRODUCING PLASMA OF DIFFERENT SHAPES

[75] Inventor: Michel Moisan, Zenon Zakrzewski, both of Montreal, Canada

[73] Assignee: Universite de Montreal, Montreal, Canada

[21] Appl. No.: 229,501

[22] Filed: Aug. 8, 1988

Related U.S. Application Data

[62] Division of Ser. No. 903,519, Jul. 2, 1986, Pat. No. 4,810,933.

[30] Foreign Application Priority Data

Jul. 5, 1985 [CA] Canada ..... 486389

[51] Int. Cl.[4] ..... H01J 11/04

[52] U.S. Cl. ..... 315/39; 315/111.21; 315/248; 313/231.31; 313/634

[58] Field of Search ..... 315/39, 111.21, 248, 315/267; 313/231.31, 634

[56] References Cited

U.S. PATENT DOCUMENTS

| | | | |
|---|---|---|---|
| 3,641,389 | 12/1972 | Leidigh | 315/39 |
| 3,705,319 | 12/1972 | Goldie et al. | 315/39 X |
| 4,049,940 | 9/1977 | Moisan et al. | 313/231.31 X |
| 4,792,725 | 12/1988 | Levy et al. | 315/39 |

*Primary Examiner*—James J. Groody
*Assistant Examiner*—Mark R. Powell
*Attorney, Agent, or Firm*—Cushman, Darby & Cushman

[57] ABSTRACT

The present invention relates to a device for generating plasma (ionizing gas) by a propagating surface wave. The device comprises a wave launching structure mounted on a plasma vessel and connected to an impedance matching network. The latter comprises a coupler and a tuner which is either formed by a section of a transmission line or is of the lumped circuitry type. The launching structure may either generate an azimuthally symmetric or a non symmetric propagating wave. This invention also relates to a method and a device for shaping plasma which comprises a plasma vessel receiving a surface wave generator and having a serviceable portion of a size and/or shape substantially different from the shape and/or size of the portion of the plasma vessel receiving the wave generator.

15 Claims, 5 Drawing Sheets

SURFACE WAVE LAUNCHERS TO PRODUCE PLASMA COLUMNS AND MEANS FOR PRODUCING PLASMA OF DIFFERENT SHAPES

This is a division of application Ser. No. 903,519, filed July 2, 1986, now U.S. Pat. No. 4,810,933.

The present invention relates to a device for producing a plasma by a propagating electromagnetic surface wave. The invention also comprehends an apparatus and a method for shaping the plasma generated by a propagating surface wave.

Devices for generating plasma have been known for many years. An example of a conventional plasma generator, of the so called DC type, comprises an elongated tube which contains a gas to be energized. Two electrodes protrude into the tube and a discharge is created therebetween in response to a DC voltage excitation applied to the electrodes. In the discharge, the gas contained in the tube is ionized and creates the plasma.

However, the DC plasma generators present numerous drawbacks. For example, it has been observed that the electrodes wear out since they are submitted to an intense heat and must be replaced after a certain period of time. Also, the electrode's erosion contaminates the plasma gas rendering the apparatus unsuitable for certain purposes where extreme gas purity is required.

In order to obviate these disadvantages, a new method for generating a plasma has been created in the recent years. According to this method, use is made of a spatially properly distributed electromagnetic (hereinafter "EM") field for energizing the plasma gas, instead of a DC discharge. The plasma gas is contained in a plasma vessel, the walls of which are made of a low loss dielectric material, allowing the EM field to penetrate throughout. The electric component of the EM field applied to the gas accelerates the electrons within it and these, in turn, through collisions, ionize some of the gas particles, thus forming the plasma. Once the gas in the plasma vessel has been ionized, surface waves will begin to propagate along the interface between the tube and the plasma, and will sustain the latter.

The surface waves are excited through a high-frequency launching structure which is relatively small and surrounds only a portion of the plasma tube. It has been observed that when the power transferred to the plasma exceeds a certain threshold level, the plasma column length will increase with the power supplied thereto. Therefore, plasma columns, much longer than the launching device itself can be readily obtained. As an example, a launching structure occupying a few centimeter along the plasma tube can be used to produce a few meter long plasma column. In fact, the plasma columns obtainable by a surface wave plasma generator are limited only either by the length of the plasma tube itself or by the amount of power that the launcher and the discharge tube can withstand.

An example of such a device makes the subject of U.S. Pat. No. 4,049,940 issued on Sept. 20, 1977, to ANVAR. The device described in this document comprises a surface wave launcher coaxially mounted on the plasma vessel and which approximately reproduces, in a plane transverse to the direction of propagation, the EM field configuration of the surface wave to be excited. The launching region is constituted by a gap formed between two metallic members. The device also comprises an impedance matching network integrated with the metallic members for ensuring an optimum power transfer from a power generator to the plasma.

It has been observed however, that such device while being generally satisfactoy when operating with high-frequency surface wave, presents some drawbacks when an operation at low frequencies, i.e. below 100 MHz is necessary. In fact, the impedance matching part of the plasma generator grows so large at low frequencies that it becomes cumbersome even in a laboratory. For example, a plasma generator that can be perfectly matched at 80 MHz is about 70 cm long. Therefore, with such size it is no longer attractive for most applications. Further, this device can only be used to launch azimuthally symmetric surface waves.

The surface wave plasma generators exhibit many desirable properties relative to other kinds of plasma generators, especially of the DC type, as it appears from the above comments. However, in some areas the attractiveness of the surface wave plasmas has been imparted by their limited volume. Plasmas of large volume are required for example in plasma chemistry, in surface processing over large areas and, as an active medium for large diameter lasers. However, the diameter of the plasma vessel, over which the wave can be launched, cannot exceed approximatively $\lambda/4$, or preferably should be less than $\lambda/8$ where $\lambda$ is the free space wavelength of the propagating wave. Therefore, increasing the plasma volume can be achieved only by lowering the wave frequency. This, however, leads to increased dimensions of the wave launcher and drastically reduces the available electron density (the density is approximately proportional to the frequency squared). Further, for some applications, the required shape of the serviceable portion of the plasma tube does not correspond to the shape of the plasma vessel section on which the wave launcher is mounted. Therefore, the need for a plasma shaping device allowing to provide plasmas of various shapes and sizes has been felt for some time.

Accordingly, it is an object of this invention to provide a surface wave plasma generator capable of operating at relatively low frequencies and at the same time being of a relatively small size.

Another object of this invention is to provide a surface wave plasma generator capable of exciting an azimuthally non symmetric surface wave.

A further object of this invention is to provide a method and a device for shaping plasma generated by a propagating surface wave.

In a first embodiment, the device for generating a plasma, according to this invention, comprises a wave launching structure mounted on the plasma vessel and to which is connected through a coaxial cable an impedance matching network constituted by a lumped circuitry, i.e. comprising discrete inductive and/or capacitive components. The impedance matching network is connected to a power generator supplying energy to the plasma.

The impedance matching network is preferably adjustable for achieving an optimum energy transfer from the generator to the launching structure and also for achieving a satisfactory operation at different frequencies.

Another embodiment of a surface wave plasma generator according to this invention, comprises a wave launching structure mounted to the plasma vessel and to which is attached a coupler connected to the power generator. A tuner, preferably adjustable, is integrated with the launching structure. The tuner may be constituted by a standard transmission line (coaxial line) short-circuited at one end and connected to the launching structure through a connector. The tuner may also be constituted by a balanced line.

The surface wave plasma generator for exciting an azimuthally non symmetric surface wave, according to this invention, comprises a launching structure constituted by two metallic members mounted on the circumference of the plasma vessel and facing each other. To the launching structure is connected an impedance matching network through which a power generator supplies energy to the plasma. It is important that the electric waves reaching the metallic members are in a proper phase relatively to each other, in order to achieve a proper operation. The required phase relations depend on the wave mode to be excited. A phase difference of 180° corresponds to the m=1 mode (so called dipolar mode) but the operation is not limited to such value.

The surface wave plasma generators according to this invention, whose structure has been outlined above, may be of a modular construction for facilitating the interchangeability of the launching structures and the impedance matching networks. Such modular construction also facilitates the installation of the plasma generator over the plasma vessel.

The method and the device for shaping plasma according to this invention, exploit a fundametal property of the surface waves which is that they propagate along the interface between media of different electromagnetic parameters. Since, as stated earlier, the diameter of the tube which received the launching structure, cannot substantially exceed $\lambda/4$ and in most of the cases should preferably be less than $\lambda/8$, a way of obtaining, for example, a discharge cross-section having a much larger diameter than the diameter of the plasma vessel section receiving the launching structure, consists of enlarging, as required, the serviceable portion of the plasma vessel. It has been found that the surface wave will propagate and will follow the enlargement and create therein a much larger diameter plasma than in the launching region.

In fact, various shapes and sizes of plasma may be produced by forming the serviceable portion of the plasma vessel according to the desired plasma shape. Further, closed serviceable portions may be utilized such as spherical or pear shaped bulbs.

A plasma generated in closed bulb shaped vessel may advantageously be used as a lamp.

Further, the axial distribution of the electron density in the plasma may be shaped by utilizing an axially non uniform plasma vessel. It has been found that the axial density profile of the plasma depends upon the shape and/or size of the vessel and using conical plasma vessels having different characteristics, the axial density profile may be varied.

Accordingly, the present invention comprises a device for generating a plasma in a dielectric vessel extending along an axis and containing a gas to be energized, said device comprising:

an electromagnetic propagating surface wave launching structure having an opening adapted to receive therein said vessel of dielectric material, said wave launching structure including first and second metallic members slightly spaced apart from each other in order to define a launching gap therebetween for reproducing in a plane substantially transverse to said axis, an electromagnetic field configuration of the surface wave to be excited;

a coupler mounted to said wave launching structure, said coupler defining a capacitance with said launching structure, and being adapted to be connected to a power generator for coupling power therefrom to said wave launching structure through said capacitance; and a tuner constituted by a length of a short circuited coaxial transmission line connected between said first and second members for introducing an imaginary impedance therebetween.

The invention also comprises a device for generating a plasma in a dielectric vessel extending along an axis and containing a gas to be energized, said device comprising:

an electromagnetic propagating surface wave launching structure having an opening adapted to receive therein said vessel of dielectric material, said wave launching structure including first and second metallic members slightly spaced apart from each other in order to define a launching gap therebetween for reproducing, in a plane substantially transverse to said axis an electromagnetic field configuration of the surface wave to be excited;

a coupler mounted to said wave launching structure, said coupler defining a capacitance with said launching structure, and being connected to a power generator for coupling power therefrom to said wave launching structure through said capacitance; and tuning means of a balanced line type attached to said wave launching structure and being electrically connected to said first and second members for establishing an imaginary impedance therebetween.

The present invention also comprises a device for generating a plasma in a dielectric vessel extending along an axis and containing a gas to be energized, said device comprising:

an electromagnetic propagating surface wave launching structure having an opening which is to receive said vessel of dielectric material, said wave launching structure including first and second metallic members slightly spaced apart from each other to define a launching gap therebetween for reproducing, in a plane substantially transverse to said axis an electromagnetic field configuration of said surface wave to be excited;

an impedance matching network connected between said first and second members and being formed of lumped elements, said network being adapted to be connected to a power generator, said impedance matching network establishing a power transfer from said generator to said surface wave launching structure.

This invention further comprises a device for generating a plasma in a dielectric vessel extending along an axis and containing a gas to be energized, said device comprising:

an azimuthally non symmetric propagating surface wave launching structure having an opening adapted to receive therein said vessel, said wave launching structure including first and second metallic members mounted on either side of said vessel and facing each other, said metallic members being slightly spaced apart from each other to define a launching zone for exciting an azimuthally nonsymmetric surface wave adapted to propagate along said axis; and an impedance matching network connected to said launching structure and adapted to be connected to a power generator supplying energy to impedance matching network, said power generator operating at a frequency compatible with said impedance matching network and said launching structure, said impedance matching network sending an electric wave to each metallic member, the electric waves reaching said first and second metallic members having a substantial phase difference therebetween.

The plasma shaping device according to this invention most generally comprises a surface wave plasma generating device, comprising:

a propagating surface wave generator having an opening:

a vessel of dielectric material containing a gas to be energized, by said surface wave generator, said vessel including:

(a) a surface wave generator receiving portion mounted in said opening and closely conforming thereto;

(b) a serviceable portion having a shape and a size corresponding to the shape and the size of the plasma to be produced, said serviceable portion having a shape and/or size substantially different from the shape and/or size of said surface wave generator receiving portion.

This invention further comprises a method of producing a plasma having a given shape and size, said plasma being produced by a progagating surface wave, said method comprising the steps of:

generating a plasma in a dielectric vessel containing a gas to be energized, the plasma being generated by a surface wave generator emitting a propagating surface wave in said vessel, said generator having an opening receiving a portion of said vessel, said portion closely conforming to said opening, said portion having a shape and/or size substantially different from the shape and/or size of the plasma to be produced; and conforming the surface wave emitted by said generator to the shape and size of the plasma to be produced, inside said vessel.

The present invention also includes:

a surface wave plasma generating device comprising:

a propagating surface wave generator having an opening;

a tapered vessel of dielectric material containing a gas to be energized and being inserted in said opening, the plasma is to be formed in said tapered vessel, said plasma having an axial density profile influenced by the shape and/or size of said vessel.

A detailed description of several embodiments of the present invention will now be given with reference to the annexed drawings in which.

Figure 14:
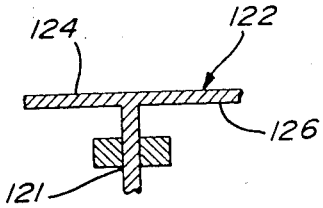
Figure 14A:
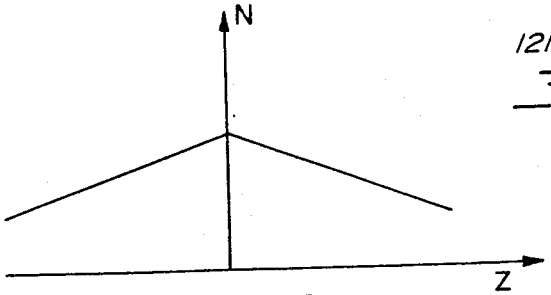
Figure 18:
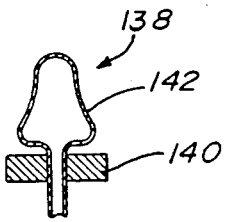
Figure 19:
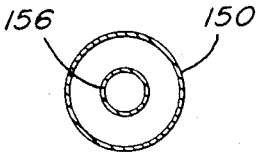
Figure 20:
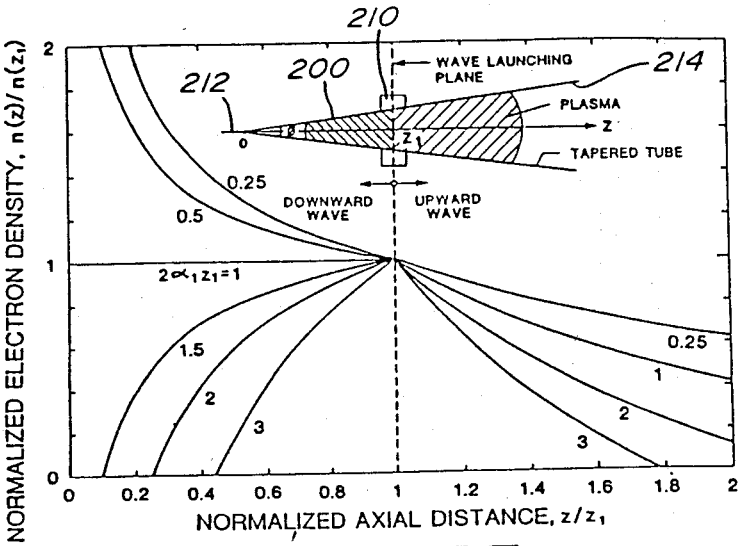

FIG. 14*a* is a graph showing the relation between the electron density and the distance from the lauching region in the device of FIG. 14;

FIGS. 15 to 19 illustrate further embodiments of plasma shaping devices according to this invention; and FIG. 20 illustrates a tapered plasma vessel and a graph showing the relationship between the normalized electron density and the normalized axial distance of the vessel.

Figure 1:
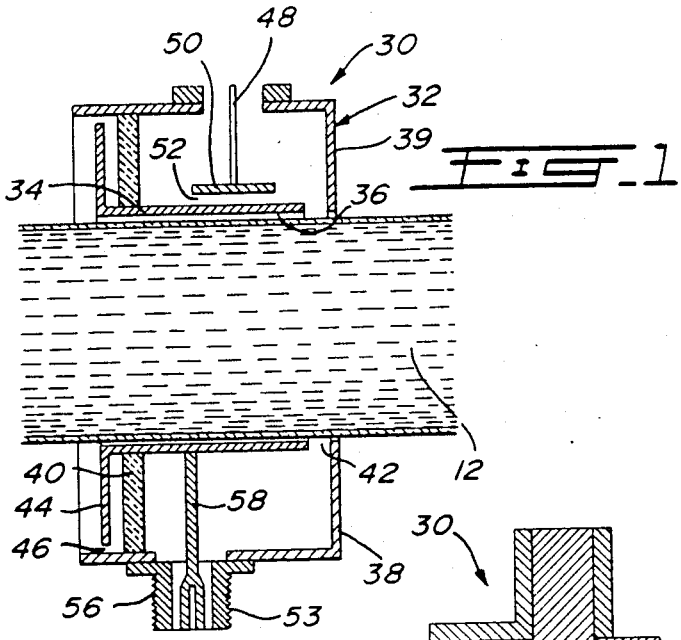
FIG. 1 is a sectional view of an embodiment of a surface wave launching structure according to this invention.
Figure 2:
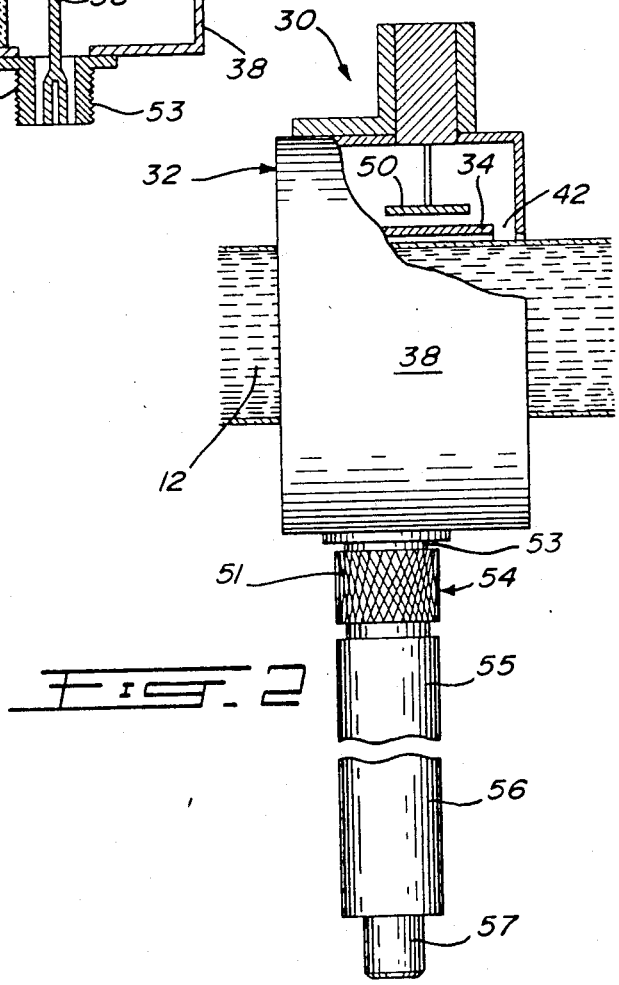
FIG. 2 is a side view, partly sectionnal, of a plasma generator whose launching structure is illustrated in FIG. 1.

With reference to FIGS. 1 and 2, a surface wave plasma generator 30 comprises a wave launching structure 32 to which is mounted an impedance matching network constituted by a coupler 48 and a tuner 55. Launcher 32 is coaxially mounted on a plasma vessel 12, made of dielectric material and containing a gas to be energized. Launcher 32 comprises metallic sleeve or member 34 defining an opening 36 through which tube 12 is to be inserted and also comprises an outer metallic member or tube 38 coaxial to member 34 and being attached thereto by an insulating ring 40 made, for example, of Teflon (Trademark) material. Members 34 and 38 are slightly spaced apart from each other and member 38 comprises a radially inwardly projecting wall 39 extending toward member 34 and defining therewith a wave launching gap 42 for obtaining the desired field distribution of the surface wave to be excited. For reducing as much as possible spurious field components in the launching gap vicinity, a flange 44 is formed at one end of member 34. A small spacing 46 is left between flange 44 and outer member 38.

Coupler 48 comprises a plate 50 and is connected to the inner conductor of a semi-rigid coaxial cable (not shown) connected in turn to a suitable power generator (not shown). The shield of the coaxial cable is connected to member 38.

Plate 50 extends in the vicinity at gap 42 and defines with member 34 a capacitance through spacing 52, through which the power from the generator is coupled to the launcher 32. The coupler 48 is radially moveable with respect to the axis of the plasma vessel 12 by any suitable means (not shown) for adjusting the capacitive spacing 52 for tuning purposes.

On the outer member 38 is mounted the male part 53 of a two terminals connector 54 having an outer metallic threaded surface 56 and a central conductor or terminal 58 connected to member 34.

The threaded surface 56 constitutes the other terminal of connector 54 and is electrically connected to member 38.

With reference to FIG. 2, the male part 53 threadedly receives the female part 51 of connector 54 to which is connected a tuner 55 constituted by a length of coaxial transmission line 56 short-circuited at one end 57 and extending transversely relatively to the axis of the plasma vessel 12. Such coaxial line introduces an imaginary impedance where it is connected. The value of this impedance is derived in practice either by using a standard coaxial tuning stub with a sliding short (57) or by connecting alternatively different length of standard short-circuited coaxial lines of various lengths at the male part 53. The required length of the tuning stub is generally about $\lambda/8$ (where $\lambda$ is the free-space wave length of the EM field).

The wave launcher 32 provides an unsymmetrical plasma column with respect to the launching gap 42, since the surface wave emitted therethrough, toward flange 44, is more rapidly damped that the wave emitted in the other direction. Therefore, the plasma extending towards flange 44 will be shorter than the plasma extending in the other direction. By varying the length of members 34 and 38, the dampening effect may be adjusted.

Launching structure 32 is mainly capable of exciting an azimuthally symetric surface wave.

Figure 3:
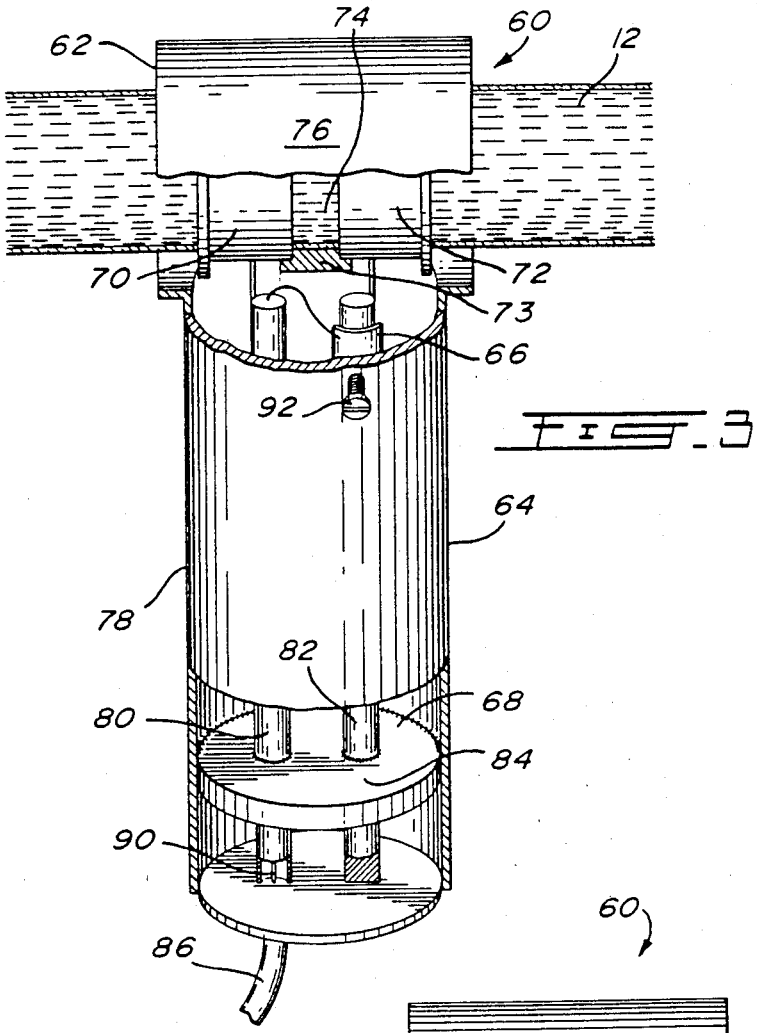
FIG. 3 is a perspective view, partly sectional of another embodiment of a plasma generator according to this invention.

FIG. 3 illustrates a surface wave plasma generator 60 designed to produce an axial symmetrical plasma with respect to the launching gap region. The generator 60 is designed to be fed with a symmetric line and comprises a wave launching structure 62 to which is connected an impedance matching network 64 comprising a coupler 66 and a tuner 68 of a balanced line type.

The launching structure 62 comprises two symmetrical metallic members or sleeves, 70 and 72 coaxially mounted on the plasma vessel 12. Members 70 and 72 are slightly spaced apart from each other for defining a launching gap region 74. Members 70 and 72 are retained to a casing 76 by a ring 73 of insulating material. Casing 76 projects laterally relatively to vessel 12 and defines a sleeve 78 containing the impedance matching network 64 comprising the coupler 66 and the tuner 68.

Tuner 68 is constituted by two parallel metallic conductors 80 and 82 connected to members 70 and 72 and being short-circuited by a slidingly movable plate 84. The tuner 68 introduces an imaginary impedance between members 70 and 72, which may be adjusted by moving the sliding plate 84. The latter is in electrical contact with casing 78 and it is guided by the latter.

The outer conductor of a coaxial cable 86 from a power generator (not shown) is connected to the casing 78. The central conductor 90 of cable 86 passes through conductor 80 and forms a section of a coaxial line. Conductor 90 is connected to coupler 66 defining a capacitance with conductor 82 and with member 72 since the two are connected together. Coupler 66 is retained to casing 78 by a dielectric screw 92 threadedly engaged therein. By rotating screw 92 this capacitance may be adjusted by varying the distance between coupler 66 and conductor 82.

It should be noted that the impedance matching network 64 not only ensures the possibility of impedance matching but also performs the functions of a balun transformer from a coaxial feeder to a symmetrical line.

Figure 4:
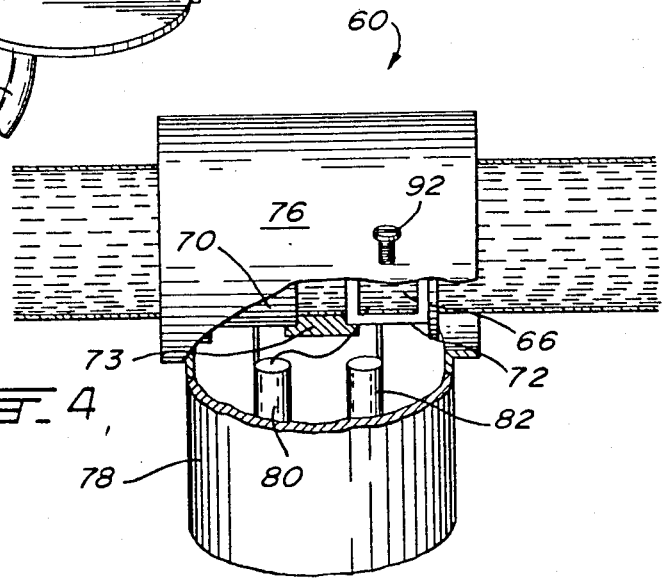
FIG. 4 is a variant of the device illustrated in FIG. 3.

FIG. 4 illustrates a variant of plasma generator 60. In this case, coupler 66 is mounted adjacent to sleeve 72 and establishes directly a capacitive coupling therewith instead through the intermediary of conductor 82. The position of coupler 66 is also adjustable by rotating the dielectric screw 92 engaged in casing 76 or 78, as explained earlier.

Plasma generators 30 and 60 operate well in a frequency range between 10 MHz and 1 GHz. However this frequency range maybe extended.

Figure 5:
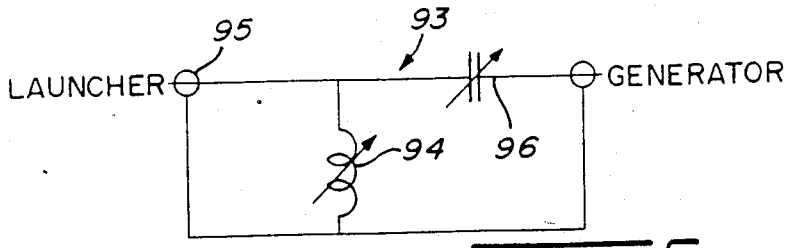
FIGS. 5 and 6 are schematic diagrams of impedance matching networks according to this invention.

FIG. 5 is a diagram of an impedance matching network 93 which operates well in a frequency range between 500 KHz and 150 MHz. This frequency range can be further extended. The impedance 93 matching network may advantageously be used with the wave launching structures 32 or 62, already described. Impedance matching network 93 is a lumped element two port circuit which is adapted to be inserted between the launcher and the coaxial feeding line from the power generator. The circuit is attached to the launcher with a coaxial link and comprises a variable coil 94 and a variable capacitance 96. For utilizing network 93 with the launching structure 32 illustrated in FIG. 2, the output port 95 may be connected to structure 32 through the coaxial connector 54. In that case, the coupler 48 is to be completely removed from launcher 32.

Figure 6:
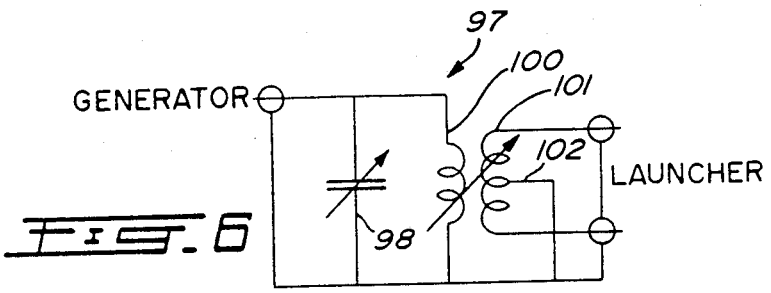

The diagram in FIG. 6 is a lumped elements impedance matching network 97, operating well in a frequency range between 500 KHz and 150 MHz and which may be further extended if desired. Network 97 establishes a connection with a launching structure through a symmetric line and comprises a variable capacitor 98 connected in parallel to the primary winding of a variable transformer 100. The output terminals of the secondary winding 101, of transformer 100 are connected to the launching structure, which may advantageously be the launcher 62, shown in FIGS. 3 and 4. The middle point 102 of secondary winding 101 is to be connected to the shielding box of the matching network and to the casing 76.

If the launching structure 62 is to be utilized with network 97, conductors 80, 82 and coupler 66 are to be removed. Subsequently, the output terminals of secondary winding 101 are connected to respectively members 70 and 72.

Figure 7:
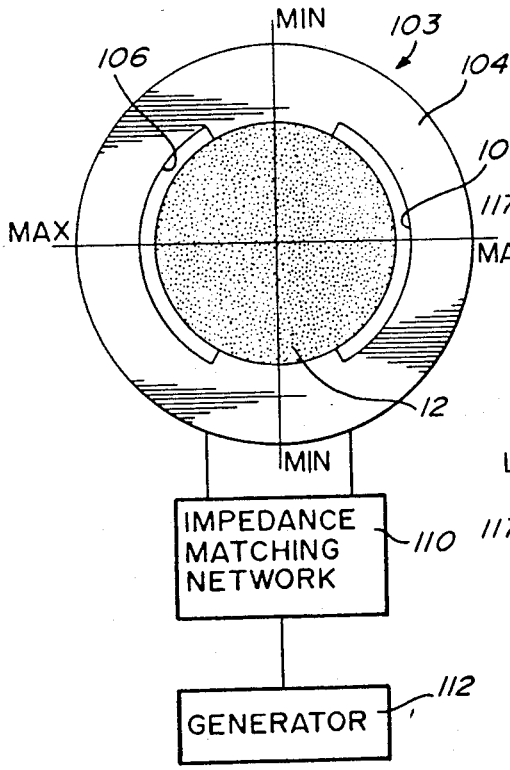
FIG. 7 is a plan view of an azimuthally non symmetric surface wave plasma generator.
Figure 8:
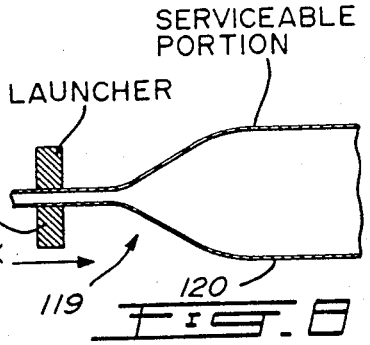
FIGS. 8 to 14 illustrate various embodiments of plasma shaping devices according to this invention.
Figure 9:
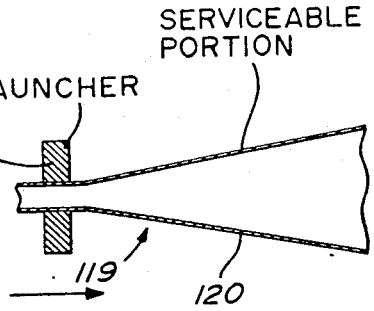

The launching structures which have been described earlier generate only azimuthally symmetric waves. In the case where an azimuthally non symmetric wave excitation is required, for example, the plasma generator 103 illustrated in FIG. 7 may be used. The launcher 103 excites waves of dipolar symmetry. The launching structure 104 comprises two substantially semi-circular members 106 and 108 facing each other and being mounted on either side of a plasma vessel 12. To the launching structure 104 is connected an impedance matching network 110 of the lumped elements type, for example, and which is fed by a power generator 112.

In order to achieve a proper operation of the plasma generator 103, an impedance matching network of symmetric output has to be employed, such as that shown in FIG. 6.

The operation of the launching structures 32 and 62 is as follows.

Initially, when no plasma is present in the dielectric tube or vessel 12, and the power generator is activated, an electric field is established between coupler 48 or 66 and one of the metallic members forming the wave launching structure. The electric field has a direction generally normal to the coupler plate, and in the launching gap region, is oriented mainly, along the axis of tube 12. If the electric field is of a sufficient amplitude, it will ionize the gas contained in the vessel, producing the plasma. Subsequently, a surface wave will begin to propagate between the walls of tube 12 and the plasma, the power from the frequency generator being coupled to the launching structure through the capacitive spacing defined between the coupler and the adjacent metallic member.

The plasma generator 103, for launching azimuthally nonsymmetric surface waves, operates as follows.

When the power generator is activated, an electric field with a direction transverse to the axis of tube 12 will be established between members 106 and 108. The gas in vessel 12 will be ionized and plasma will be produced. Subsequently, surface waves of a dipolar symmetry will begin to propagate along the interface between the plasma and the walls of the dielectric tube 12, for sustaining the plasma and extending the length thereof.

Since the launching region of launcher 104 does not completely encircle tube 12, the propagating wave will have an amplitude which is not constant when measured along the circumference of tube 12. In other words, the wave will be azimuthally non symmetric. The amplitude of the propagating wave will be maximum in the region designated "MAX" in FIG. 7, whereas the minimum "MIN" will be situated in a position generally transverse to the maximum amplitude position.

The property of the propagating surface wave which resides in that it is always concentrated in the vicinity of the plasma-dielectric interface can be advantageously used to extend the variety of dimensions and shapes of the plasma beyond the limits imposed by a straight cylindrical constant diameter plasma tube. The propagating surface wave plasma generators which may be used for this purpose are not limited to those described earlier.

FIGS. 8 to 11 illustrate plasma vessels 119 comprising each a serviceable portion 120 whose shape and/or size differ substantially from the shape and/or size of the portions of vessels 119 on which are mounted the surface wave launchers 117. The diameter of the plasma tube 119 can be increased (FIGS. 8 and 9) or reduced (FIGS. 10 and 11) along the wave path.

Efficient surface wave generators cannot have aperture diameters larger or close to $\lambda/4$ otherwise a lesser amount of the EM energy emitted by the generator is converted into surface wave energy, since the available EM energy has the tendency to be transformed into space waves. For this reason it seems more efficient to use tube diameters that are smaller than $\lambda/4$, or still better, less than $\lambda/8$. Practically, this corresponds to a 45 mm diameter plasma at 915 MHz and to about a 15 mm one at 2.45 GHZ. These diameter values can be too small for some application. Decreasing the wave frequency would allow to produce a larger diameter plasma but this usually considerably reduces the electron density (except at high gas pressures). One way of increasing the plasma diameter and keeping a relatively high value of electron density, is to use the plasma vessels of FIGS. 8 and 9.

Figure 10:
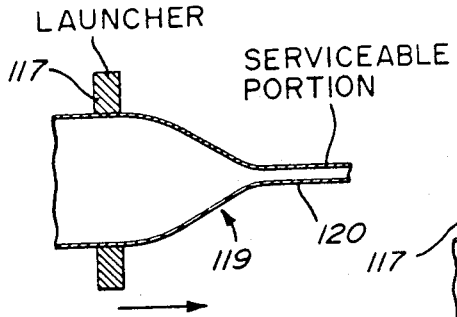

For tube diameters that are smaller than the aperture of the launcher available, the plasma column may be excited by disposing directly part of this smaller tubes into the launcher. However, this method is not efficient in term of the EM energy converted into surface waves. The largest launcher efficiency for surface wave is achieved when the plasma diameter is very close, or equal, to the launcher aperture. This means that the wave excitation in a plasma generator as shown in FIG. 10 still remains an efficient one even if the serviceable portion diameter is much smaller than the launcher aperture.

Regarding the tapered plasma vessels shown in FIGS. 8 to 11, the transition portions between the serviceable portion of the plasma vessel and the portion thereof receiving the plasma generator, over which the plasma type progressively changes to the required shape and size should be long enough and smooth. If this is not the case, an important part of the surface wave energy will be reflected back toward the launcher and, also, part of the surface wave energy will be converted, at the transition point, into a radiation wave or space wave (a space wave is a wave that propagates in all direction and, thus, is not attached to the plasma-tube interface). In that respect, experiences show that a transition over half a free space wavelength seems to be a good compromise.

Figure 11:
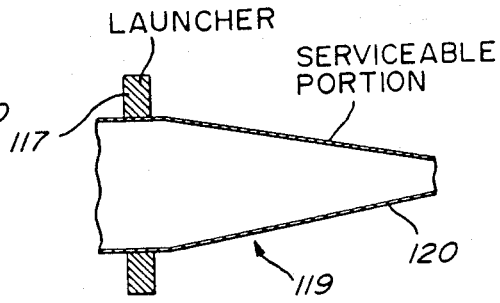

It has been shown experimentally and theoretically that the electron density decreases (about linearly) in the direction of propagation, which implies that the plasma column produced, is actually inhomogeneous. This phenomena may be a disadvantage in certain application. For correcting this inhomogeneity the plasma tube diameter may be decreased in a smooth and generally constant manner, in the direction of propagation, as illustrated in FIG. 11. The required tapering of the tube can be determined experimentally or calculated. Another way of reducing the axial inhomogeneity of the plasma is to use a T-shaped tube described hereinafter.

FIG. 14 shows such an arrangement. The wave emerges from the launcher at the base 121 of the T-shaped plasma vessel 122, where it is divided into two waves of the same power flow, propagating in opposite directions in the two arms 124 and 126, respectively of vessel 122. For a given plasma length along the arms 124 and 126, the plasma is more homogeneous axially than if one launcher was used at one end of a straight tube having the same lenght. This may be visualized on the graph of FIG. 14*a* showing the electron density (N) with respect to the distance (Z) along the arms or conduits 124 and 126.

Figure 15:
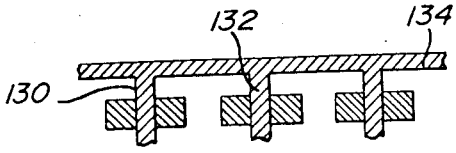

FIG. 15 is a variant where T-tubes 130, 132 and 134 have been stacked to have a longer plasma column with an axial density variation as small as possible. Note that in this case, the various launchers should not be supplied from the same power generator, i.e., the surface waves excited by various launchers should not be coherent one with the others, otherwise they will interfere and a standing wave pattern will appear along the plasma column.

Figure 16:
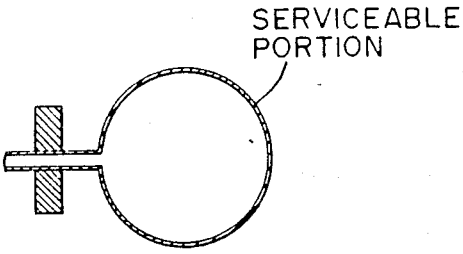
Figure 17:
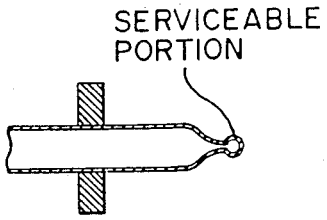

FIGS. 16, 17 and 18 illustrate plasma vessels having closed serviceable portions or bulbs.

FIGS. 16 and 17 show how to obtain a spherical plasma. The device in FIG. 17 could be used, for example, to produce a high density plasma for a spectral lamp that can be considered optically as a point source.

Figure 13:
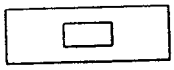

FIG. 19 is a cross sectional view, transverse to the axis of the plasma vessel and showing that an annular plasma can be produced, using two concentric tubes 150 and 156 the ionized gas being located in-between these two tubes. Also, as illustrated in FIG. 13, an annular plasma having a rectangular cross-section can be obtained.

Figure 12:
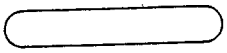
Figure 12A:
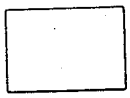

Also, flat or rectangular plasmas may be obtained by utilizing the devices shown in FIGS. 12 and 12*a*, being respectively cross-sectional views of a flat and rectangular serviceable portions of plasma vessels.

The shapes given above are only examples and are not limitative of the shapes and dimensions of plasmas that can be obtained with the surface wave technique.

An example of a fluorescent lamp 138 that can be realized with elements from the present invention is illustrated in FIG. 18. In this example, the plasma generator 140 is provided with a lumped circuitry matching network, the generator 140 acting also as a base holder for the lamp 138. The tube 142 illuminates as a result of the surface wave emitted by the launcher that propagates along the tube envelope (the surface wave plasma generators and the light tube could be arranged in a large variety of ways depending on the application it is intended for). Tube 142 contains mercury vapor generating ultra violet light converted into visible light by using some appropriate coating (e.g. phospor) on the tube inner wall.

The insert in FIG. 20 shows a cross-sectional view of a tapered plasma vessel 200 on which is mounted a surface wave generator 210 of a suitable type. On the same figure is also shown the graph giving the relation of the normalized electron density $n(z)/n(z_1)$ of the plasma in vessel 200 with reference to the normalized axial distance $z/z_1$ of the plasma vessel. The value $z_1$ corresponds to the position of the launching plane along which the surface wave generator extends.

More specifically, vessel 200 has a conical shape and comprises ends 212 and 214, closed or connected to other parts of the apparatus. The cone angle of vessel 200 is designated by $\phi$.

It has been observed that the axial density of the plasma in vessel 200 depends upon the shape and the size of the latter and may be varied, as will be shown hereinafter.

With reference to FIG. 20, the surface waves are excited in the $z_1$ plane and travel in both directions along the z axis. The waves travelling in the z and $-z$ directions are designated "upward" and "downward" wave, respectively.

The electron density in a column sustained by the downward wave decreases, increases or remains constant with an increasing distance from the wave launching plane, depending upon the value of $2\alpha_1 z_1$, ($\alpha_1$, being the wave attenuation coefficient at $z=z_1$. Thus, conditions ($\phi$, gas pressure, electron density) may be sought, for which the density is axially uniform. This feature can be of interest for some applications.

The specific description of several embodiments of the present invention should not be interpreted in any limiting manner since it is given only for illustrative purposes. The scope of this invention is defined in the following claims.

The embodiments of the invention in which an exclusive property or privilege is claimed are defined as follows:

1. A device for producing plasma of given shape and size, comprising:

a surface wave launcher that can be energized, formed with an opening;

a vessel having an inner surface, completely made of dielectric material and containing a gas that can be ionized, said vessel including:

(a) a surface wave launcher receiving portion inserted in said opening and conforming thereto, said opening comprising means for transferring energy from said surface wave launcher to said gas in the receiving portion to ionize the latter gas;

(b) a usable portion having a shape and size corresponding to the shape and size of the plasma to be produced, said receiving and usable portions of the vessel being substantially different from each other in cross-sectional shape or size; and (c) a smooth, tapered transition portion for interconnecting the said receiving and usable portions;

whereby, in operation, ionization of the gas in the receiving portion produces plasma and a surface wave propagating on the inner surface of the vessel from the said receiving portion to said usable portion through the said transition portion to thereby create in the said usable portion the plasma having the shape and size of the usable portion.

2. A device as defined in claim 1, in which said smooth, tapered transition portion comprises means for propagation said surface wave without reflection and without conversion of the surface wave into space wave propagating in all directions.

3. A device as defined in claim 1, wherein said receiving portion of the vessel has a circular cross-section.

4. A device as defined in claim 2, wherein said receiving portion of the vessel tapers toward said usable portion.

5. A device as defined in claim 2, wherein said usable portion has a longitudinal axis and is of a generally constant circular cross-section along its longitudinal axis.

6. A device as defined in claim 5, wherein the said receiving portion has a cross-sectional area smaller than the cross-sectional area of said usable portion.

7. A device as defined in claim 5, wherein said receiving portion of the vessel has a cross-section area larger than the cross-section area of said usable portion.

8. A device as defined in claim 1, wherein said vessel is constituted by a header comprising a main conduit to which are connected in fluid communication therewith a plurality of tubes, on each tube being mounted a surface wave launcher for emitting a surface wave in the associated tube, each surface wave launcher being supplied with energy from a separate electric power supply to prevent a definite phase relationship between the surface waves emitted by the different launchers.

9. A device as defined in claim 1, wherein said usable portion has a generally rectangular cross-section.

10. A device as defined in claim 1, wherein said usable portion is substantially flat.

11. A device as defined in claim 1, wherein said usable portion has an annular shaped cross-section.

12. A device as defined in claim 1, wherein said usable portion is a spherical bulb.

13. A device as defined in claim 1, wherein said usable portion is a pear-shaped bulb.

14. A device as defined in claim 1, wherein said usable portion comprises a discharge opening, said usable portion tapering down toward said discharge opening for achieving a substantially constant electron density of the plasma in said usable portion.

15. A device as defined in claim 1, wherein said vessel is T-shaped and comprises a central tube in fluid communication with two oppositely extending conduits, the surface wave launcher being mounted on said central tube.

* * * * *